United States Patent [19]

Yoshimura

[11] Patent Number: 4,830,629

[45] Date of Patent: May 16, 1989

[54] SHIELDED ELECTRICAL CONNECTOR AND METHOD OF WIRING SAME

[75] Inventor: Yoshikazu Yoshimura, Tokyo, Japan

[73] Assignee: Hirose Electric Co., Ltd., Tokyo, Japan

[21] Appl. No.: 160,289

[22] Filed: Feb. 25, 1988

Related U.S. Application Data

[63] Continuation-in-part of Ser. No. 30,621, Mar. 27, 1987, abandoned.

[30] Foreign Application Priority Data

Jun. 4, 1986 [JP] Japan ..... 61-128039

[51] Int. Cl.[4] ..... H01R 13/658

[52] U.S. Cl. ..... 439/610; 439/456

[58] Field of Search ..... 439/607-610, 439/456

[56] References Cited

U.S. PATENT DOCUMENTS

| | | | |
|---|---|---|---|
| 3,643,208 | 2/1972 | Massa, Jr. | 439/610 |
| 3,744,128 | 7/1973 | Fisher et al. | 439/610 |
| 4,457,576 | 7/1984 | Cosmos et al. | 439/610 |
| 4,497,533 | 2/1985 | Genova et al. | 439/610 |
| 4,514,029 | 4/1985 | Lax et al. | 439/610 |
| 4,557,545 | 12/1985 | Ohtsuki et al. | 439/607 |
| 4,582,384 | 4/1986 | Frantz et al. | 439/611 |
| 4,585,292 | 4/1986 | Frantz et al. | 439/611 |
| 4,629,276 | 12/1986 | Genaro et al. | 439/459 |
| 4,674,807 | 6/1987 | Boteler et al. | 439/607 |

*Primary Examiner*—Neil Abrams

*Attorney, Agent, or Firm*—Takeuchi Patent Office

[57] ABSTRACT

A shielded electrical connector comprises a plurality of contacts each having a connecting end to be connected to a mating connector and a termination end to which a cable is to be connected; an insulating housing for holding the contacts between their connecting and termination ends; an enclosing shell for the connecting ends of the contacts; and a metal hood for enclosing the insulating housing and adapted to be electrically connected to the shield member of the cable, the metal hood having a receiving part for receiving the insulating housing, a sleeve member to be crimped to the shield member, and a hood section between them for enclosing the termination ends of the contacts, the enclosing shell and the metal hood being adapted to be joined together.

4 Claims, 3 Drawing Sheets

SHIELDED ELECTRICAL CONNECTOR AND METHOD OF WIRING SAME

CROSS-REFERENCES TO RELATED APPLICATIONS

This application is a continuation-in-part of Ser. No. 030,621 filed Mar. 27, 1987, now abandoned.

BACKGROUND OF THE INVENTION

The present invention relates to a shielded electrical connector with little radio or other electromagnetic wave interference and a method of its connection to a cable.

Conventional electrical connectors used for a computer or other machine have transmitted noises, or radio or other electromagnetic waves, picked up by their cables or other parts to the computer, thus presenting a problem (generally referred to as "EMI"). In order to prevent such EMI, Japanese U.M. Patent Kokai No. 59-139581 has proposed an improved electrial connector. This electrical connector comprises a cylindrical metal housing, a sleeve to be crimped to the external and grounding conductors of a cable, and means provided at the edge opposite to the sleeve for attaching the connector to a mating connector. The electrical cable has a plurality of conductors passing through the sleeve into the housing. The connector also has a plurality of electrical terminals to be connected to the respective conductors of the cable and a cover for holding said terminals mechanically and electrically connected to the housing so that the housing may be shielded and grounded.

The cable conductors and the connector housing of such a shielded connector are almost completely enclosed by an assembly of the metal sleeve, cylindrical housing, and metal terminal cover to thereby shield the connector from electromagnetic waves.

However, the afore-mentioned shielded electrical connector has the following shortcomings.

The metal housing and crimp sleeve are made separate and then joined together by crimping. As a result, the mechanical strength of the joint is so low that the joint can be broken by the vibration or load of the cable. Before crimping, the joint portions have been subjected to a bending and/or folding process, thus subjected to a large stress in the process so that there is a danger of being fractured or broken at the joint when the sleeve is crimped to a cable. If this happens, an insulating material enters the metal housing, causing a trouble such as broken conductor of the cable.

SUMMARY OF THE INVENTION

Accordingly, it is an object of the present invention to provide a shielded electrical connector with a sleeve portion sufficiently strong to withstand against stresses such as the cable load, crimping operation, and overmolding pressure.

It is another object of the invention to provide a shielded electrical connector simple in structure and easy to assemble.

According to the invention there is provided a shielded electrical connector including a metal housing having a hood portion and an integrally formed sleeve member. More specifically, the shielded electrical connector includes a plurality of contacts each having a connecting end to be connected to a mating connector and a termination end to which a cable is to be connected; an insulating housing for holding the contacts between their connecting and termination ends; an enclosing shell for the connecting ends of the contacts; an integrally formed metal hood for enclosing the insulating housing and adapted to be electrically connected to a shield member of the cable; and the integrally formed metal hood having a receiving part for receiving the insulating housing, a sleeve member to be crimped to the shield member of the cable, and a hood section between the receiving part and the sleeve member for enclosing the termination ends of the contacts.

According to another aspect of the invention there is provided a method of terminating a cable to a shielded electrical connector such as described above, which includes the steps of passing a cable through the sleeve member of an integrally formed metal hood; connecting respective conductors of the cable to corresponding termination ends of the contacts; securing the integrally formed metal bond to the enclosing shell; and crimping the sleeve member to the shield member of the cable for making both mechanical and electrical connection.

The connector according to the invention has satisfactory strength, especially at the sleeve portion, improved shielding property, and no joint gap through which any insulating material can enter during the molding operation. Other objects, features, and advantages of the invention will be more apparent from the following description taken in conjunction with the accompanying drawings.

DESCRIPTION OF THE PREFERRED EMBODIMENTS

Figure 1:
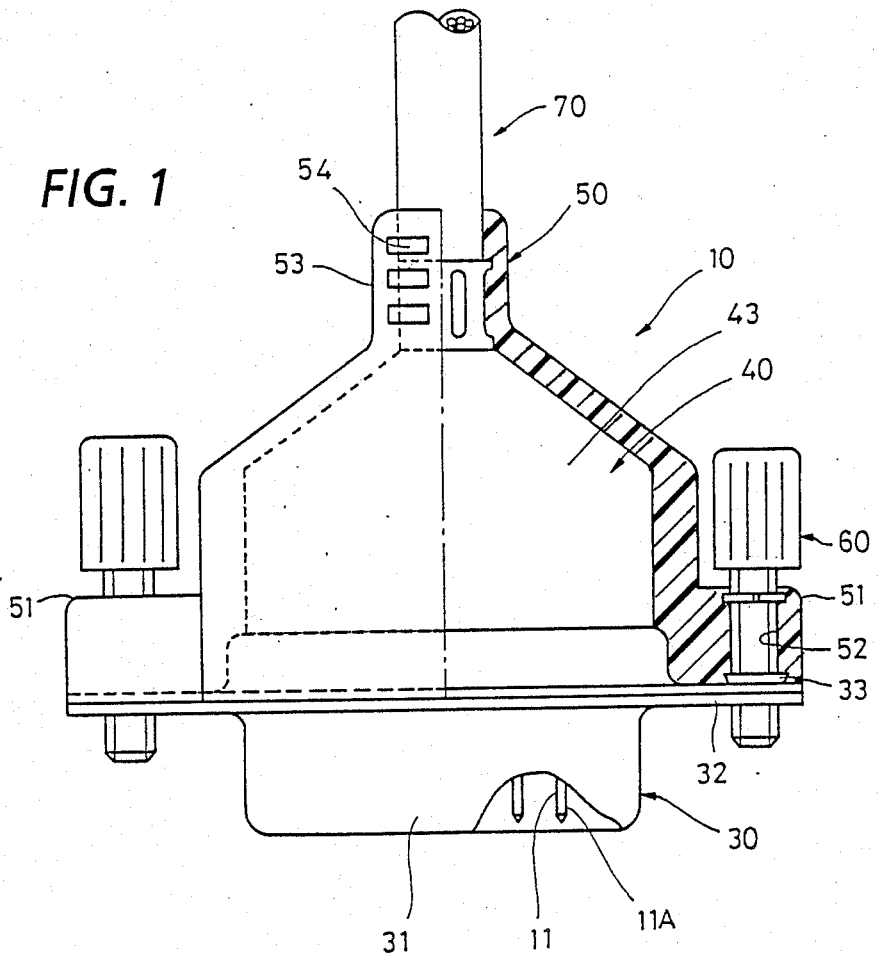
FIG. 1 is an elevational view, partially in section, of a connector to which a cable has been connected according to an embodiment of the present invention.

In FIGS. 1 through 5, there is shown a connector 10 which includes a plurality of contact pins 11, an insulating housing 20, a contact enclosing shell 30, and an insulating molding 50. The contact pin 11 is made of conductive metal and has an connecting end 11A to engage a mating connector and the other or termination end (not shown) to which a cable conductor is electrically terminated. The contact pins 11 shown in FIG. 1 are of the male type but may be of the female.

Figure 2:
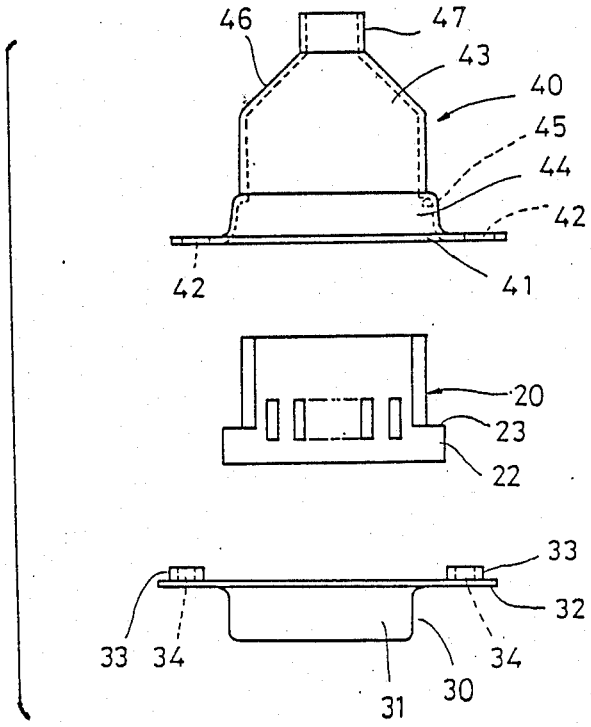
FIG. 2 is an exploded elevational view of the metal hood, insulating housing, and enclosing shell of the connector of FIG. 1.

As best shown in FIG. 2, the insulating housing 20 is made of a plastic in such a configuration that it may hold the plurality of pins 11 at a position between the connecting and termination portions. It has a pair of extended portions 22 with stepped portions 23. The exdended portions 22 are designed to fit into the receiving portions 44 of a metal hood 40 in such a manner that the metal hood may cover the insulating housing 20.

The contact enclosing shell 30 is made of a metal sheet by means of a press. It has a contact enclosing section 31 and a flange 32 adapted to join to the flange 41 of the metal hood 40. The flange 32 has a pair of holes 34 with raised edges 33 to be deformed for connection.

The metal hood 40 is made of a metal sheet by means of a drawing press so as to have the flange 41 adapted to join to the flange 32 of the enclosing shell 30. The flange 41 has a pair of holes 42 for receiving the raised edges 33 of the enclosing shell 30. The metal bond 40 has a hood section 43 for enclosing the respective conductors 71 of a cable 70 and the insulating housing 20. The hood section 43 has a receiving part 44 with a pair of stepped portions 45 for engaging the pair of stepped portions 23 for the insulating housing 20. The hood section 43 has a pair of shoulders 46 converging to a cylindrical sleeve 47 to be deformed or crimped to the shield 72 of a cable 70.

As best shown in FIG. 1, the hood section 43, to which the cable 70 has been connected at the sleeve, is covered by an insulating molding 50 in such a manner that the insulating molding may integrate with the sheath of the cable 70. The insulating molding 50 has a pair of end portions 51 with a hole 52 through which a locking means 60 is inserted. It has a neck portion 53 for enclosing the sleeve 47 of the metal hood 40. The neck portion 54 has a plurality of recesses 54 for retention of its elasticity. The locking means 60 is, for example, a metal screw to be screwed imto a mating connector (not shown).

A method of assembling and/or terminating such a shielded electrical connector will be described.

Figure 3:
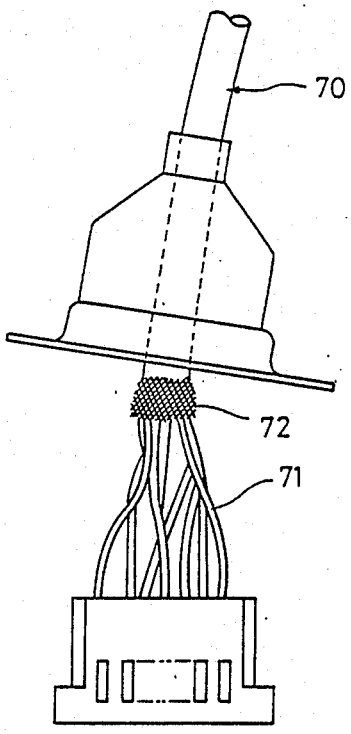
FIGS. 3 through 5 are elevational views showing how to assemble the connector of FIG. 1.

(1) First of all, the cable 70 is passed through the sleeve 47 and its sheath is peeled off to expose respective conductors 71. The ends of conductors 71 are connected by soldering, crimping, or insulation piercing to the termination ends of contacts 11 held by the insulating housing 20. At the same time, the shield member 72 is exposed and preferably fixed by a conductive tape or the like (FIG. 3).

(2) The metal hood 40 is then put over the insulating housing 20. The enclosing shell 30 is then joined to the metal hood 40 by inserting the raised edges 33 into the holes 42 and deforming them for making both mechanical and electrical connection.

Figure 4:
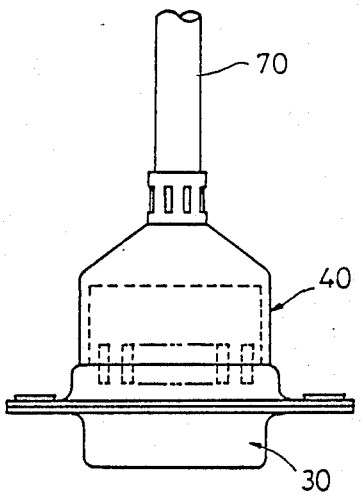

(3) The sleeve 47 of the metal hood 40 is then crimped to the shield member 72 of the cable 70 for both mechanical and electrical connection (FIG. 4).

Figure 5:
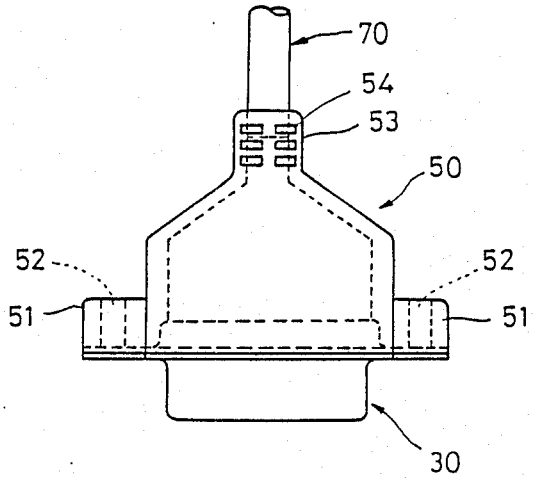

(4) The above assembly is then put into a metal die for forming an insulating molding 50 (FIG. 5).

(5) Finally, the locking means are screwed into the fixing holes 52 of the insulating molding 50 (FIG. 1).

Figure 6:
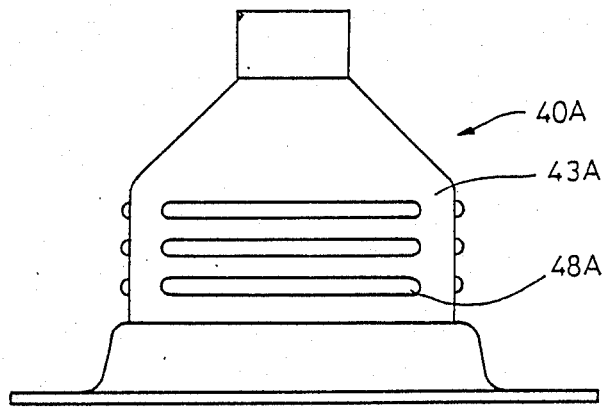
FIG. 6 is an elevational view of a metal hood according to another embodiment of the invention.

FIG. 6 illustrates another embodiment in which the metal hood is modified. The hood section 43A of a metal hood 40A has a plurality of ribs 48A to thereby prevent the metal hood 40A from falling off from the insulating molding 50. The ribs 48A not only reinforce the metal hood 40A so that it may withstand the load applied but also prevent operator's fingers from slipping on the hood section in plugging or unplugging operation. As a result, the application of an insulating molding 50 may be eliminated.

Figure 7:
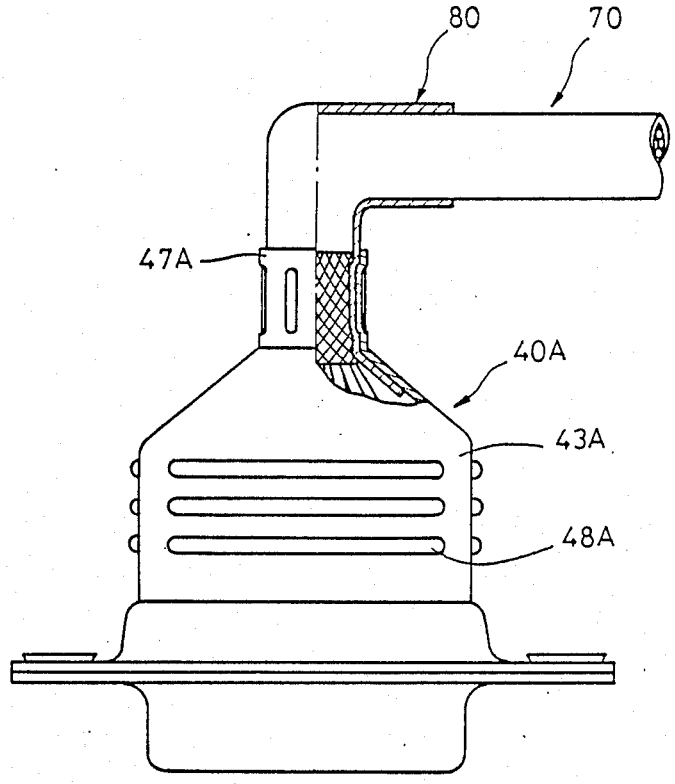
FIG. 7 is an elevational view, partially in section, of a connector with a metal hood according to still another embodiment of the invention.

FIG. 7 shows still another embodiment in which the metal hood is modified. An L-shaped tube 80 is provided through the sleeve 47A of the metal hood 40A so as to facilitate bending and directing of the cable 70. Of course, the bending angle is not limited to 90 degrees as illustrated.

According to the invention there are provided the following advantages.

(1) Since the receiving part, hood section, and sleeve member are integrally formed to provide a one-piece metal hood, there is no or little danger of the metal hood being damaged by the crimping operation at its sleeve joint and vibration of the cable or load applied to the cable.

(2) As described above, the metal hood is integrally formed so that when the sleeve is crimped to a cable, both the hood section and the sleeve portion can withstand the stress without receiving any damage.

(3) Since the metal hood no seams or gaps, no insulating material can flow into the metal hood even in press molding operation of the insulating layer surrounding the metal hood, thus eliminating the possibility of breaking electrical conductors attributable to the insulator leakage.

(4) The metal hood, which is completely integrated as described above, can be made by means of a drawing press, requiring a smaller number of parts, making it suitable to mass production, thus reducing the unit manufacturing cost.

(5) The integrated metal hood is so strong that the connector can be used without any jacket or overmolding, further reducing the number of parts and thus the unit manufacturing cost.

Although the preferred embodiments of the invention have been described in conjunction with the accompanying drawings, other embodiments and modifications which would be apparent to one having ordinary skill in the art are intended to be covered by the spirit and scope of the appended claims.

What is claimed is:

1. A shielded electrical connector comprising:

a plurality of contacts each having a connecting end to be connected to a mating connector and a termination end to which a cable is to be connected;

an insulating housing for holding said contacts between their connecting and termination ends;

an enclosing shell for said connecting ends of said contacts;

an integrally formed tube-like, seamless metal hood for enclosing said insulating housing and adapted to be electrically connected to a shield member of said cable; and said integrally formed metal hood having a receiving part for receiving said insulating housing, a sleeve member to be deformed to said shield member of said cable, and a hood section between said receiving part and said sleeve member for enclosing said termination ends of said contacts.

2. The shielded electrical connector of claim 1, wherein said metal hood has a plurality of ribs thereon in planes perpendicular to a longitudinal axis of said sleeve.

3. The shielded electrical connector of claim 1, wherein said metal hood has guiding means of a generally L-shaped tube, with one end fitted into and deformed to said sleeve member for holding and directing said cable.

4. A method of terminating a cable to a shielded electrical connector having a plurality of contacts each having a connecting end to be connected to a mating connector and a termination end to which a cable is to be connected; an insulating housing for holding said contacts between their connecting and termination ends; an enclosing shell for said connecting ends of said contacts; and an integrally formed metal hood for enclosing said insulating housing and electrically connected to a shield member of said cable; said metal hood having a concave part for receiving said insulating housing, a sleeve member deformed to said shield member and a hood section between them for enclosing said termination ends of said contacts; and said enclosing shell being electrically connected to said metal hood, said method comprising the steps of:

passing a cable through said sleeve member of said integrally formed metal hood;

connecting respective conductors of said cable to corresponding termination ends of said contacts;

securing said integrally formed metal hood to said enclosing shell; and deforming said sleeve member to said shield member of said cable for making both mechanical and electrical connection.

* * * * *